United States Patent [19]

Takami

[11] Patent Number: 4,850,179

[45] Date of Patent: Jul. 25, 1989

[54] PACKAGE STRAPPING MACHINE

[76] Inventor: Masaho Takami, 9-50, Kohrienyamanote-cho, Hirakata-shi, Osaka-fu, Japan

[21] Appl. No.: 176,171

[22] Filed: Mar. 31, 1988

[30] Foreign Application Priority Data

Jun. 19, 1987 [JP] Japan ..... 62-95057[U]

[51] Int. Cl.[4] ..... B65B 13/06; B65B 13/18

[52] U.S. Cl. ..... 53/589; 53/582; 100/26; 100/33 PB

[58] Field of Search ..... 53/582, 589; 100/26, 100/33 PB

[56] References Cited

U.S. PATENT DOCUMENTS 3,749,622 7/1973 Sato ..... 53/582 X 3,771,436 11/1973 Sato ..... 100/33 P B 3,914,153 10/1975 Sato ..... 53/582 X

*Primary Examiner*—John Sipos

*Attorney, Agent, or Firm*—Wenderoth, Lind & Ponack

[57] ABSTRACT

A package strapping machine is capable of strapping a package with an adjusted, gentle force by welding ends of a thermoplastic strap. The machine is provided with a strap-elevating member in proximity to a strap-receiving element mounted on a pivotal member. Overlapping ends of a thermoplastic strap are looped around the strap-receiving element and the package, and are then welded under the strap-receiving element. The strap-receiving element is then withdrawn from between an under surface of the package and the welded portion of the strap. The strap-elevating member elevates the welded portion of the strap, slackened due to gentle tightening, from a point below to a point above the height of the strap-receiving element, with the result that the slackened, welded portion of the strap is held above the strap-receiving element as it returns to its original position. The strap thus does not impede the movement of the strap-receiving element.

9 Claims, 6 Drawing Sheets

PACKAGE STRAPPING MACHINE

BACKGROUND OF THE INVENTION

This invention relates to an automatic package strapping machine for tightening a thermoplastic strap looped around a package. More particularly, it relates to an automatic package strapping machine capable of tightening a thermoplastic strap looped around a package even with well-adjusted, gentle force in order that the contents of the package may not be damaged by tightening of the strap.

Package strapping machines adapted to automatically strap a package with a thermoplastic strap drawn off a reel and weld overlapping ends of the strap by heat and pressure are widely used, because they are efficient and save manpower.

The structure of general automatic package strapping machines will now be described with reference to FIG. 8. A sliding plate 82 is horizontally supported to slide back and forth in a horizontal direction by a table 81 on which a package A to be strapped is loaded. Disposed just under the sliding plate 82 are a first clamp 83, a pressing device 84, and a second clamp 85, mounted so that they can each move up and down freely by means of a group of cams 87 secured to a cam shaft 86 driven by a motor $M_1$. Provided between the first clamp 83 and the upper end of the pressing device 84 is a cutting blade 88 adapted to cut a thermoplastic strap B. Provided between the sliding plate 82 and the pressing device 84 is a heater (not shown) that can move back and forth therebetween.

Thermoplastic strap B is drawn off a reel (not shown) and allowed to pass through a pair of upper and lower rolls 90, 89 which are rotated by motor $M_2$ to feed forward and then tighten the strap B looped around the package. The strap is fed through a strap guide 91, and a guiding groove 92 of the first clamp 83, where it is introduced into an arch (not shown) standing upright on the table 81, and then looped around the package A. A leading end of the strap is then fed beneath the sliding plate 82. The motor $M_2$ and thus the forward feeding of the strap B stops when the leading end of the strap B presses a switch (not shown).

Upper roll 90 is forwardly and backwardly rotated by the motor $M_2$, while lower roll 89 is pressed firmly against the upper roll 90 by a spring 93, so that their nipping force allows the strap to move. The lower roll 89 is also designed to increase the nipping force in association with the upper roll 90 when the strap is required to be tightened by means of a roller 95 and a spring 96 actuated by a cam 94 secured to the cam shaft 86. Because of the nipping force increase, the strap looped around the package A can be fastened without causing slip between the rolls 89, 90 and the strap.

While the first clamp 83 holds the leading end of the strap B, backward rotation of the roll 90 by the motor $M_2$ tightens the strap. Overlapping portions of the strap are then held against the sliding plate 82 by the second clamp 85, and the heater is inserted between the overlapping portions in the area between the two clamps. The pressing device moves up to first cut the trailing end of the strap with the cutting blade 88, and then press the overlapping portions and the heater together against the sliding plate 82. The heater subsequently withdraws from between the overlapping portions while the pressing device continues to press on the overlapping portions, thus welding them together. When the welding is complete the clamps 83 and 85 and the pressing device 84 are lowered.

When the welding of the thermoplastic strap is over, the sliding plate moves backward from its forward position, in order to withdraw itself from between the welded portion of the strap and the package. At the withdrawal of the sliding plate, the welded portion of the strap, which had been separated from an under surface of the package by the sliding plate, comes into contact with the package by its own tension, because of strong tightening of the strap. The sliding plate then returns to the initial forward position, passing by just under the welded portion of the strap, completing one cycle of the package-strapping machine.

However, when the thermoplastic strap is gently tightened to take into account the variety or the material of the package contents, there will form a slack in the strap under the package and sliding plate on the conventional package strapping machine. Because the welded portion of the strap remains slackened under the package, the sliding plate, which is withdrawn from between the strap and the package, can reenter the strap, or butt against the strap when returned to the forward position. This can make it difficult to remove the package from the machine, or can impede the next strap-forwarding and tightening cycle.

OBJECTS OF THE INVENTION

It is a first object of this invention to provide a packing strapping machine that can carry out gentle tightening of a thermoplastic strap, without being impeded by slackening of the strap. It is a second object of this invention to provide a package strapping machine that can lift up a welded portion of the strap higher than a strap receiving element of a pivotal member (sliding plate) lest the strap-receiving element should reenter between the strap and the package or butt against the strap when returning to an initial forward position from a backward position. The above and other objects and features of this invention will appear from the following detailed description, taken in connection with the accompanying drawings.

DETAILED DESCRIPTION OF THE INVENTION

Figure 1:
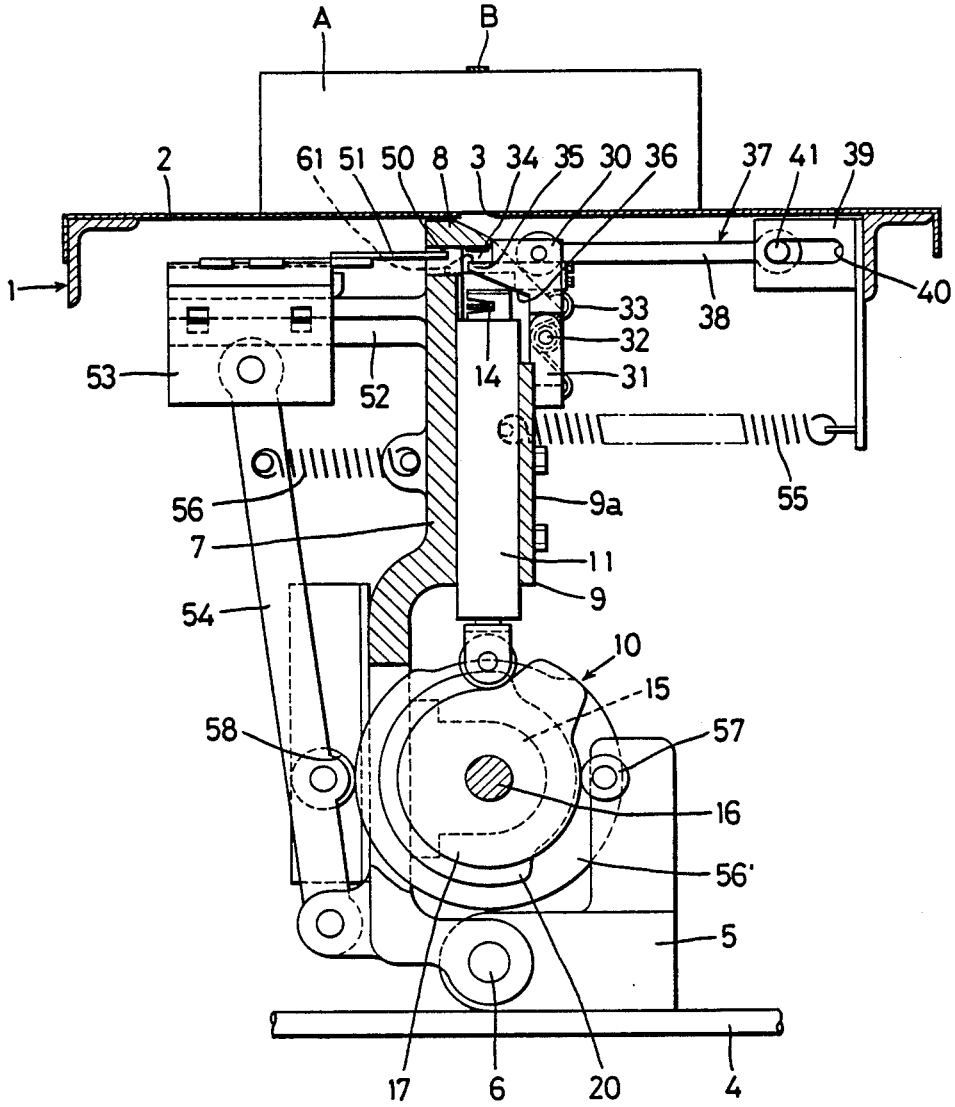
FIG. 1 is a sectional elevational view of a package strapping machine embodying this invention, which shows the condition immediately before commencement of a strapping operation.

Referring now to the drawings, a package strapping machine embodying this invention includes a table 1 having a top board 2 on which a package A to be strapped is loaded. A thermoplastic strap B is pulled out through a slot 3 provided in the top board 2. Inside the table 1 is a base plate 4 to which a pedestal 5 is secured in such a position as to be disposed under the slot 3. The pedestal 5 carries a main shaft 6, which extends parallel to the longitudinal direction of the slot 3. A plate type pivotal member, a lower end of which is fixed to the main shaft 6, is designed to be capable of swinging around the main shaft 6.

As shown in FIG. 1, the height of the pivotal member 7, in its upright position, is nearly equal to the height of the top board 2. When the pivotal member 7 is in the upright position, the right-hand vertical surface of the pivotal member 7 is designed to be flush with the left-hand edge of the slot 3. The pivotal member 7 is adapted to be swingable in a space provided on the left-hand side thereof.

As shown in FIG. 1, mounted on the pivotal member 7 are a plate type strapping receiving element 8 at the top, a holder 9 thereunder, and a cam mechanism 10 below the holder. In the illustrated embodiment, a projecting part of the strap-receiving element 8, measured in the direction transverse to the slot 3, has a breadth equal to the breadth of the slot 3, and the upper surface thereof is inclined downwardly in the direction away from pivotal member 7.

Figure 2:
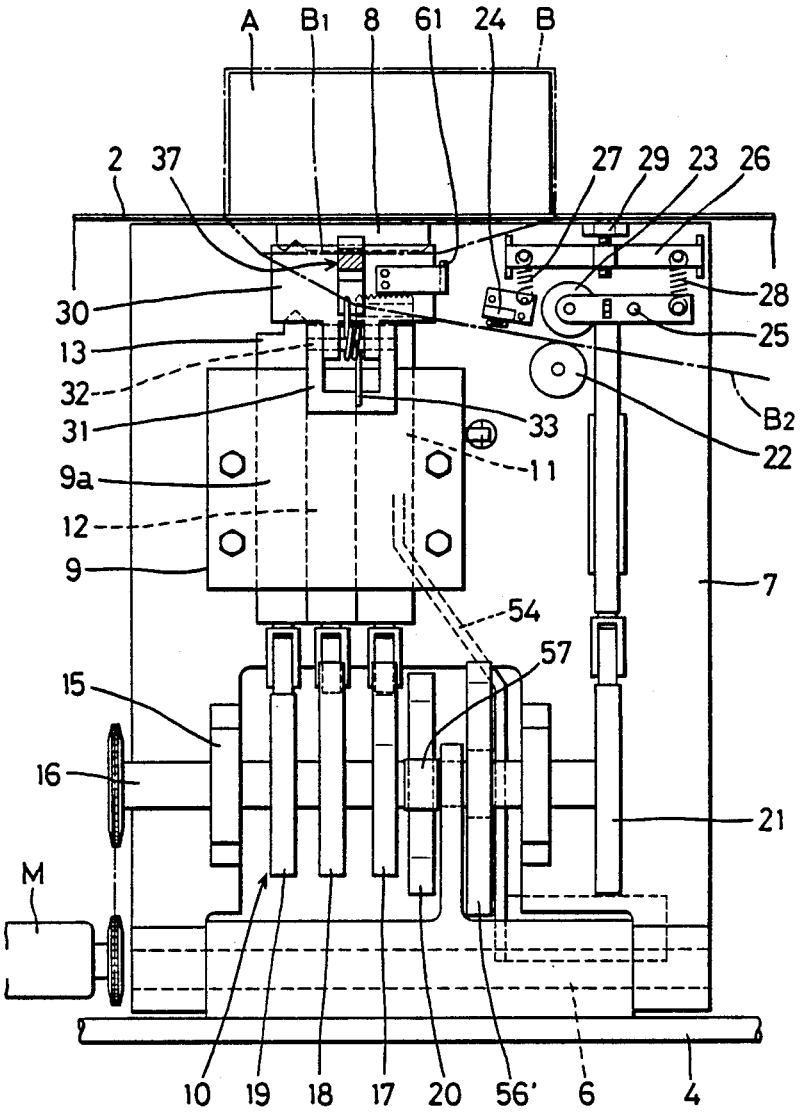
FIG. 2 is an elevational side view of the same machine as above.

As shown in FIG. 2, the holder 9 holds a first clamp 11 adapted to firmly clamp a leading end portion $B_1$ of the strap B against the strap-receiving element 8, a pressing device 12 adapted to press an overlapping portion of the strap B, and a second clamp 13 adapted to elevate and firmly hold the overlapping portion of the strap B against the strap-receiving element 8 in such a way that each of these members 11, 12, 13 can move up and down freely. At the upper end of the first clamp 11 is a kerf 14 for holding a trailing portion $B_2$ of the strap B. The edge of the kerf 14 and the upper end of the pressing device 12 form a cutting device for the lower strap $B_2$. The lower strap $B_2$ is cut by the ascension of the pressing device 12.

The cam mechanism 10 includes a horizontal cam shaft 15 rotatably supported by bearings 15 connected to the pivotal member 7, a cam 17 for lifting or lowering the first clamp 11, a cam 18 for lifting or lowering the pressing device 12, a cam 19 for lifting or lowering the second clamp 13, a cam 20 for pivoting the pivotal member, and a cam 21 for upwardly pressing a roller 22 against a roller 23, used to forward and tighten the thermoplastic strap looped around package A. The cam shaft 16 is driven by a motor M in such a way as to move these cams in accordance with a programmed timing.

The thermoplastic strap B is drawn off a reel (not shown), which can be housed inside or outside the table 1. The strap B is allowed to pass through the kerf 14 of the first clamp 11, pass by the strap-receiving element 8, pass over the pressing device 12 and the second clamp 13, and pass out onto the table 1 from the slot 3. It is then looped around the package A, and its leading end $B_1$ is inserted just under the strap-receiving element 8.

In FIG. 2, to the right of the kerf 14 are the roller 22 for use in forwarding and tightening the strap B, the roller 23 for use in nipping the strap B in association with the roller 22, and a switch 24 for detecting the tension of the tightened strap B, all of which are fixed to the pivotal member 7.

The roller 22 is rotated by a motor (not shown) clockwise and counterclockwise. The roller 23 is moved up and down by means of the cam 21, swiveling around a pivot 25. It is pressed against the roller 22 when the strap B is forwarded or tightened. When the strap is not being forwarded or tightened, the rollers 22, 23 are separated in such a way as to let the strap be pulled out therethrough manually.

When the switch 24 is pressed by the strap B, the tension of the strap has reached a certain required level, and switch 24 then stops the motor of the driving roller 22. In the illustrated embodiment, the switch 24 and the driven roller 23 are put into operation concurrently by means of an adjusting lever 26 and a pair of springs 27, 28 fixed to the same lever. Because the strength of the springs 27, 28 can be adjusted by vertical shifting of the adjusting lever 26, by the rotation of an adjusting screw 29, the tension of the strap B can be varied as desired and in accordance with what the package A contains.

A strap guide 30 adapted to insert the strap B beneath the under surface of the strap-receiving element 8 is disposed under the projecting end of the strap-receiving element 8. The strap guide 30 is pivoted to the upper end of a pedestal 31, fixed to a cover **9*a* of the holder 9 with a pivot 32 in such a way as to pivot in the same directions as the pivotal member 7. A spring 33 gives the strap guide 30 an elastic rotational power, by which the strap guide 30 is always biased toward an upright position on the pivotal member 7**.

In the upright position, the upper end of the strap guide 30 is situated a little lower than the upper surface of the strap-receiving element 8, and a left-hand surface (as seen in FIG. 1) of the strap guide 30, facing the pivotal member 7, is in contact with the strap-receiving element 8. Provided slightly under the strap-receiving element 8 is a projecting portion 35, forming a strap guide path 34 having a rectangular cross-section in conjunction with an under surface of the strap-receiving element 8. Also provided under the projecting portion 35 is a slant surface 36 inclined downwardly from the projecting portion 35 to the pedestal 31. The structure is such that when the first clamp 11 or the second clamp 13 moves upward, the upper end of that clamp butts against the slant surface 36, which causes the strap guide 30 to pivot about the pivot 32 in order to recede from the path of that clamp. Hence, the projecting portion 35 of the strap guide 30 does not at all hinder the second clamp 13 from clamping, or the pressing device 12 from pressing, the overlapping portion of the strap B.

A restricting mechanism 37 is provided between the strap guide 30 and the table 1. The restricting mechanism includes a rod 38 one end of which has a pivot connection to the strap guide 30 and the other end of which is slidably connected with a pin 41 in a horizontal elongate opening 40 bored in a plate 39. When the pivotal member 7 is in the upright position as shown in FIG. 1, the pin 41 lies in the innermost position of the elongate opening 40; thus, the rod 38 can hold the strap guide 30 in an upright position.

Figure 4:
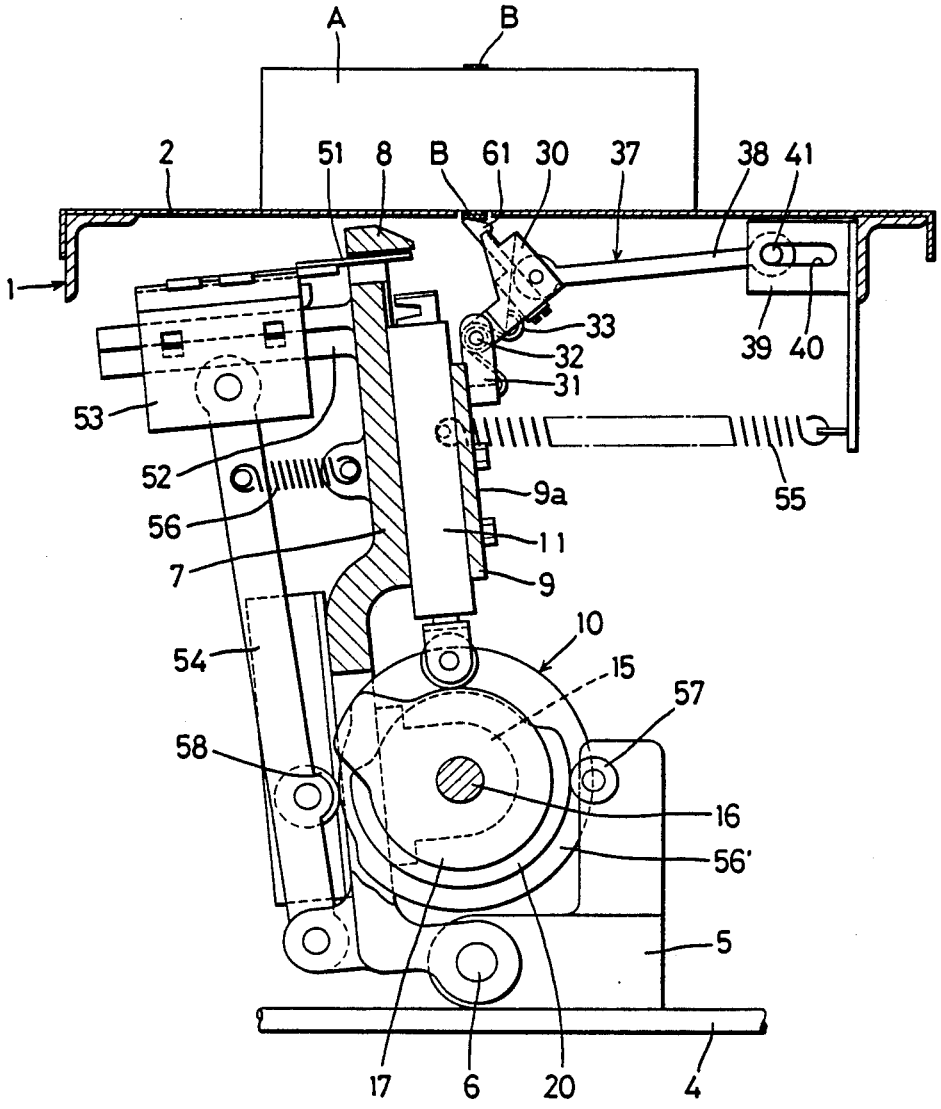
FIG. 4 is a sectional elevational view of the same machine as above, which shows the condition after the welding operation.

The strap guide 30 is restricted from moving toward the pivotal member 7 by the rod 38, so that it rotates around the pivot on the rod 38 and pivot 32, as shown in FIG. 4, when the pivotal member 7 tilts. The sliding of the pin 41 inside the elongate opening 40 enables the strap guide 30 to pivot with the ascent of the first clamp 11.

Although not shown in the drawings, a switch for detecting the leading end of the strap B in the strap guide path 34 and energizing the motor M is disposed at a front end of the strap-receiving element 8.

A horizontally elongate opening 50 is pierced through the pivotal member 7 under the strap-receiving element 8. A heater 51 which can freely enter or withdraw from the guide path 34 by way of the opening 50 is disposed on the left-hand vertical surface of the pivotal member 7, as seen in FIG. 1. The heater 51 is mounted on a guide rod 52 projectingly fixed to the pivotal member 7 by means of a slider 53 in such a way as to be freely slidable in the horizontal direction. A pivotal arm 54 whose lower end is pivoted to the pedestal 5 is pivotably connected at its upper end to the slider 53. Thus, the heater 51 can move forward and backward along with the swinging movement of the pivotal arm 54, caused by a movement of the cam mechanism 10.

A spring 55 always biases the pivotal member 7 toward the upright position, while a spring 56 always biases the heater 51 toward the guide path 34. The pivotal arm 54 maintains contact with a cam 56' via a roller 58 provided near the lower end of the pivotal arm in order to control the movement of the heater 51.

A roller 57 is mounted on the pedestal 5 so that it can roll on the outside circumference of the cam 20. Hence, the pivotal member 7 stays tilted as long as the roller 57 stays on a projecting portion of the cam 20, as shown in FIG. 4.

Figure 8:
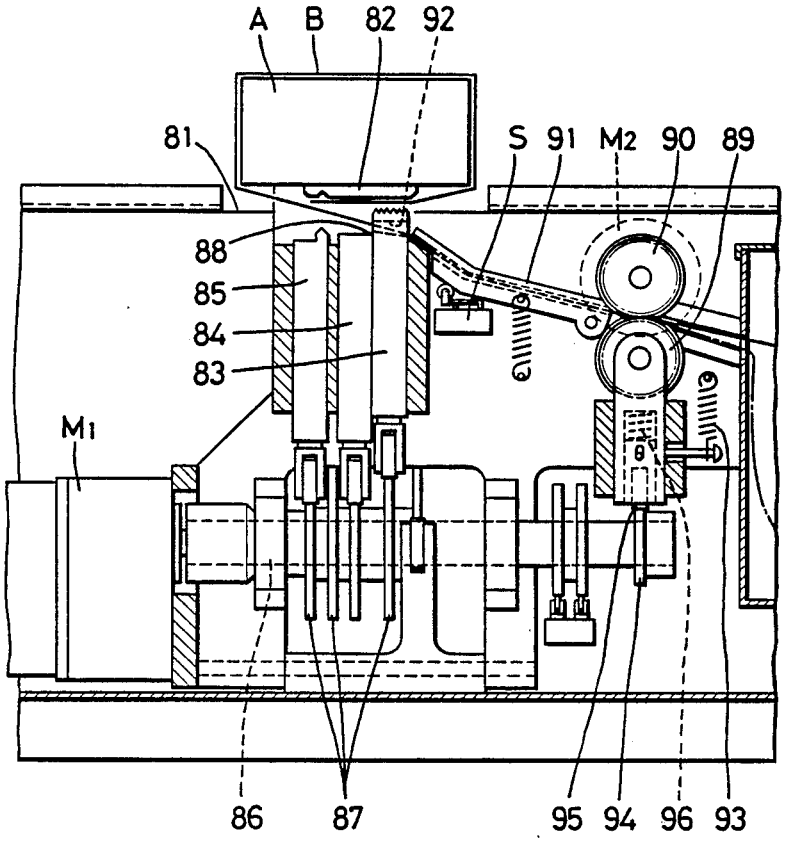
FIG.8 PRIOR ART
FIG. 8 is a sectional elevational view of a conventional package strapping machine.

Provided on the strap guide 30, just opposite to the front end of the strap-receiving element 8, is a strap-elevating member 61 adapted to elevate the welded, overlapping portion of the strap B toward the upper surface of the strap-receiving element 8. Specifically, the strap-elevating member 61 is designed in such a way as to lift up the welded, overlapping portion of the strap B higher than the upper surface of the strap-receiving element 8 as the pivotal member 7 moves into the tilted position and the strap-receiving element 8 withdraws from between the strap B and the package A. In the illustrated embodiment, the strap-elevating member 61 is fixed to the strap guide 30, taking advantage of the swinging movement of the strap guide 30. However, in possible departures from this embodiment, the strap-elevating member 61 may be disposed under and outside the front end of the strap-receiving element 8, and moved up and down by means of a solenoid or cam mechanism to elevate the welded portion of the strap B. In this respect, the package strapping machine may be provided with a sliding plate 82, as shown in FIG. 8, on condition that the machine is similarly provided with the strap-elevating member 61.

In order that this invention may be understood more clearly, reference will now be made to the strapping actions of the package strapping machine.

To begin with, the package A is placed on the top board 2, with the first clamp 11, the pressing device 12, and the second clamp 13 in the lowermost position ; the driving and the driven rollers 22, 23 stand apart as shown in FIG. 2; the pivotal member 7 is in the upright position; and a given length of the strap B is fed out onto the top board 2.

Figure 5:
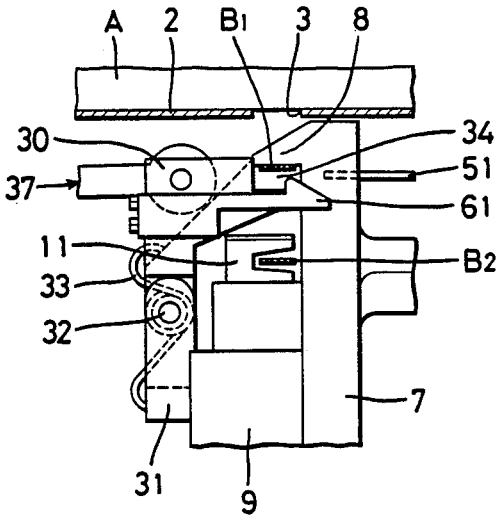
FIGS. 5–7 are illustrations showing the strap-elevating mechanism of the machine in three different operational positions.

A part of the strap B fed out onto the top board 2 is looped around the package A, and the leading end $B_1$ is received in the guide path 34, which is formed by the strap-receiving element 8 and the projecting portion 35 of the strap guide 30. At this moment, the strap-elevating member 61 is located lower than the leading end $B_1$ of the strap B, as shown in FIG. 5. The strap B cannot help going straight forward because the leading end $B_1$ is confined to the guide path 34; thus, the trailing part $B_2$ of the strap B, which is fed toward the table 1 via the kerf 14 of the first clamp 11, and the leading end $B_1$, are properly aligned vertically relative to each other.

As the leading end $B_1$ of the strap B presses the switch, the motor M is energized, which causes the cam shaft 16 to rotate. The first clamp 11 moves upward and firmly clamps the leading end of the strap B against the strap-receiving element 8. The motor M stops for a while under this condition.

Figure 3:
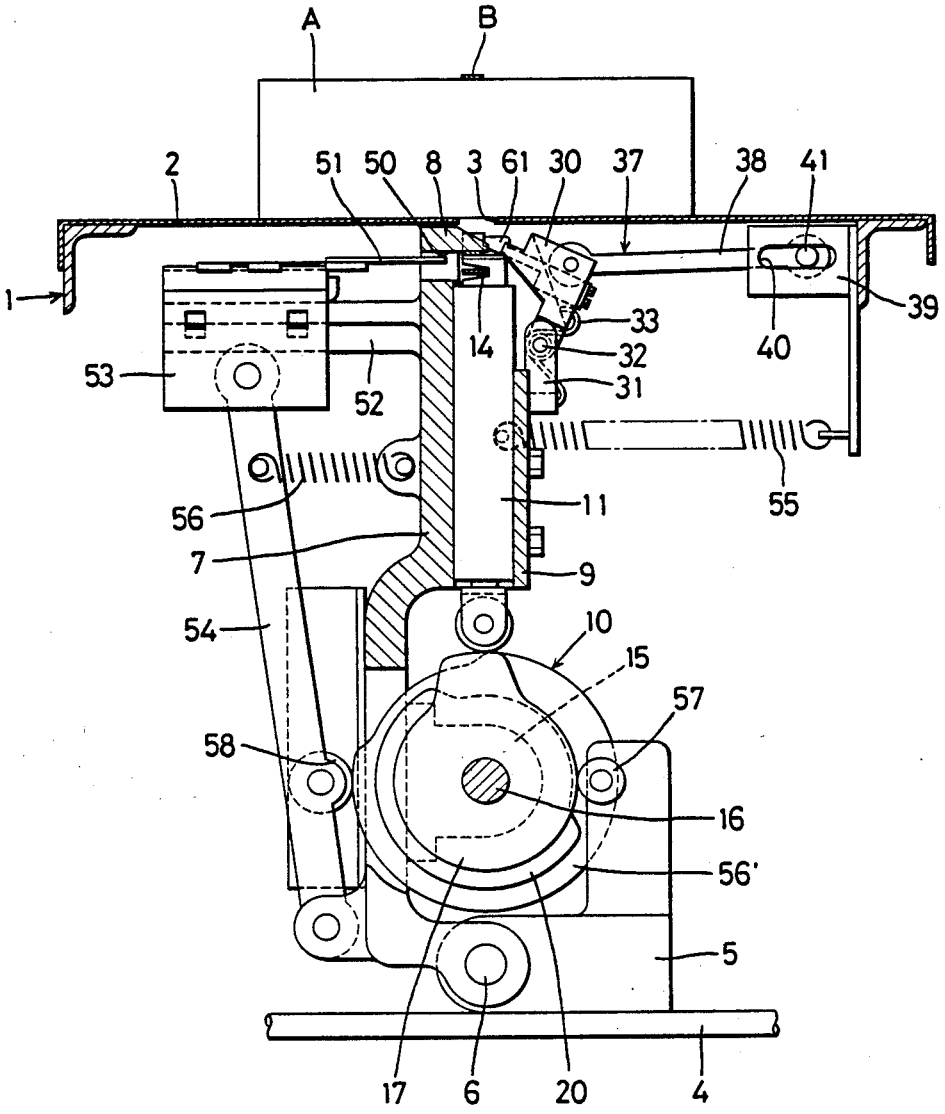
FIG. 3 is a sectional elevational view of the same machine as above, which shows the condition during a welding operation.

Because the first clamp 11 pushes up the slant surface 36 while ascending, the strap guide 30 has to recede, as shown in FIG. 3. The cam 21 brings the driven roller 23 into contact with the driving roller 22, with the strap B therebetween, and the strap looped around the package A is tightened as the driving roller 22 rotates. When the tension of the strap B reaches a desired level, the switch 24 detects it and stops the motor of the driving roller 22. At this time the motor M is energized, and the cam shaft 16 begins to rotate again. The second clamp 13 moves upward, and clamps the leading end $B_1$ and the trailing portion $B_2$ of the strap B together, so as to overlap.

Figure 6:
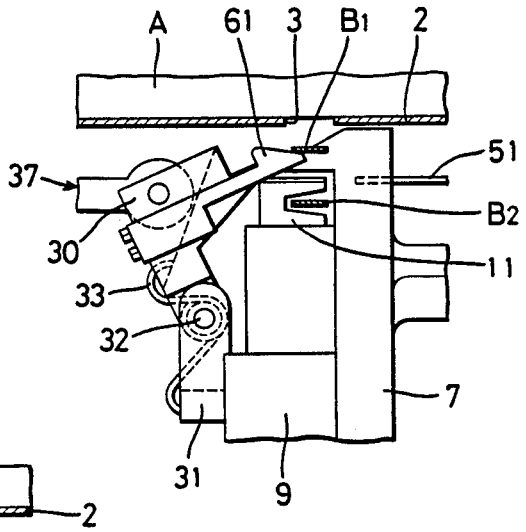

At this moment, the strap guide 30 is pushed upward, and turns while ascending. The strap-elevating member 61 moves up a little, as shown in FIG. 6, which pushes up the leading end $B_1$ of the strap B. Next, the pressing device 12 moves upward, and in cooperation with the first clamp 11, cuts the trailing part $B_2$ of the strap B in proximity to the leading end $B_1$, and then elevates the strap at the point between the second clamp 13 and the cut portion of the strap. At the same time the rotation of the cam 56 causes the heater 51 to move forward and enter between the leading end $B_1$ and the cut portion of the strap B via the opening 50. The pressing device 12 presses both ends $B_1$, $B_2$ of the strap, with the heater 51 therebetween. When both the ends of the strap are fused, the heater 51 moves backward from between them. The overlapping portion of the strap is then welded by the pressing device 12, momentarily pressing the overlapped portions together.

No sooner is welding over than the first clamp 11, the pressing device 12, and the second clamp 13 begin to move downward; subsequently, the roller 57 of the pedestal 5 rides on the projecting portion on the circumference of the cam 20, whereby the pivotal member 7 is tilted away from the strap guide 30, as shown in FIG. 4, which causes the strap-receiving element 8 to move backward and withdraw from between the strap and the package. Finally, the motor M stops.

Figure 7:
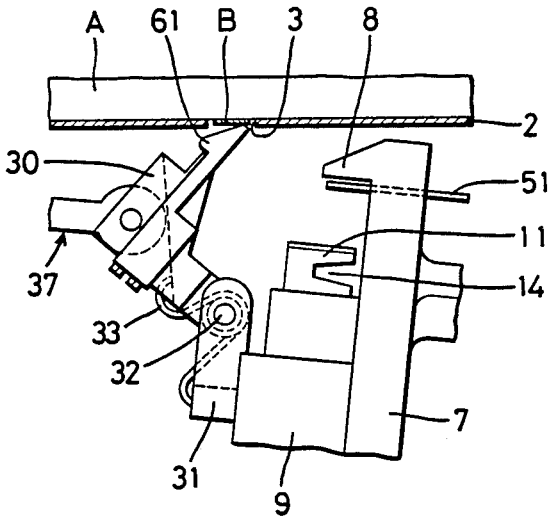

The strap guide 30 is prevented from moving toward the pivotal member 7 by the restricting member 37. As shown in FIGS. 4 and 7, the strap-elevating member 61 moves upward as the strap guide 30 rotates, which presses the welded overlapping portion of the strap B against the under surface of the package A, and holds that portion higher than the strap-receiving element 8.

The pivotal member 7 then returns to the upright position. The strap guide 30 reforms the guide path 34 under the strap-receiving element 8, as shown in FIG. 1. When the strap-receiving element 8 returns to the forward position, the motor of the driving roller 22 is energized, which causes the roller 22, 23 to pull out a prescribed length of the strap onto the table 1. When the driving roller 22 stops, the driven roller 23 is moved upwardly into the standby condition, ready for the next strapping operation. At this moment, the strap-elevating member 61 returns to the original downward position, as shown in FIG. 5.

The slackened, welded portion of a thermoplastic strap is lifted up to the under surface of a package after the strap-receiving element of the pivotal member (sliding plate) has been withdrawn from between the strap and the package; therefore, the slackening of the strap resulting from gentle tightening of the strap will not result in the strap-receiving element reentering between the strap and the package, or butting against the strap, when returning to the forward position. In this way, every strapping operation can be performed very smoothly, even with a package to be strapped gently.

What is claimed is:

1. A package strapping machine comprising:
means for looping a strap around a package;
means for receiving portions of said strap to be welded together underneath said package;
means for welding said strap portions together;
means for moving said means for receiving from a strap receiving position to a position away from said strap; and
means for elevating the welded strap portions when said means for moving moves said means for receiving away from said strap 2. The package strapping machine of claim 1, wherein said means for receiving extends from a vertically disposed pivotal member, and comprises a strap receiving element having a flat undersurface receiving said strap.

3. The package strapping machine of claim 2, wherein a strap guide is pivotally mounted to said pivotal member, pivotable between a forward pivot position and a rearward pivot position, and in said forward pivot position cooperates with said strap receiving element to form a strap guide path when said strap receiving element is in said strap receiving position.

4. The package strapping machine of claim 3, wherein said means for elevating comprises a strap elevating member mounted to said strap guide, whereby said strap elevating member is pivoted by movement of said strap guide.

5. The package strapping machine of claim 4, wherein a restricting member is connected at one end to said strap guide, and at another end to a pin sliding in an elongated opening in a plate fixed on a frame of the machine, the length of said restricting member being such that when said strap guide and said strap receiving element are in their respective positions forming said guide path, said pin is at an end of said elongated opening closest to said guide path, whereby movement of said pivotal member in a direction away from said elongated slot will cause said restricting member to pivot said strap guide into said rearward pivot position, thus elevating said strap elevating member and raising said strap.

6. The package strapping machine of claim 3, further comprising a spring biasing said strap guide toward said forward pivot position.

7. The package strapping machine of claim 3, wherein:
means for clamping said strap against said strap receiving element is virtually and slidably mounted on said pivotal member underneath said strap guide; and
said strap guide includes on an underside thereof a slant surface engageable by said means for clamping, whereby said means for clamping engages said slant surface when said means for clamping is slid vertically upward to clamp said strap, thus pivoting said strap guide out of a path of movement of said means for clamping.

8. A package strapping machine comprising:
means for looping a strap around a package;
means for receiving portions of said strap to be joined together underneath said package;
means for joining said strap portions together;
means for moving said means for receiving from a strap receiving position to a position away from said strap after said strap portions have been joined together; and
means for elevating the joined strap portions when said means for moving moves said means for receiving away from said strap.

9. A package strapping machine for gently strapping a strap about a package, comprising:
means for supporting a package to be strapped;
means for looping a strap around said package;
means for receiving a leading portion of said strap looped around said package underneath said package;
means for tightening said strap about said package to a predetermined tightness;
means for welding said leading portion together with a trailing portion of said strap to form a welded portion of said strap;
means for moving said means for receiving from a strap receiving position to a position away from said strap after said strap has been welded; and
means for elevating said welded portion of said strap when said means for moving moves said means for receiving away from said strap.

* * * * *